United States Patent [19]

Kamiya

[11] 4,121,326

[45] Oct. 24, 1978

[54] SLIDER FOR USE IN SLIDE FASTENER

[76] Inventor: Minoru Kamiya, 2-46-3, Minami-Otsuka, Toshima-ku, Tokyo, Japan

[21] Appl. No.: 811,324

[22] Filed: Jun. 29, 1977

[51] Int. Cl.[2] ..... A44G 19/26

[52] U.S. Cl. ..... 24/205.15 R

[58] Field of Search ..... 24/205.15 R, 205.15 E

[56] References Cited

U.S. PATENT DOCUMENTS

| | | | |
|---|---|---|---|
| 2,065,250 | 12/1936 | Sundback | 24/205.15 R |
| 2,072,200 | 3/1937 | DeVore | 24/205.15 R |
| 2,456,822 | 12/1948 | Engel | 24/205.15 R |
| 2,810,174 | 10/1957 | Mikulas | 24/205.15 R |
| 2,824,352 | 2/1958 | Foltis | 24/205.15 R |
| 2,840,877 | 7/1958 | Foltis | 24/205.15 R |

FOREIGN PATENT DOCUMENTS

| | | | |
|---|---|---|---|
| 504,005 | 6/1951 | Belgium | 24/205.15 R |

*Primary Examiner*—Bernard A. Gelak

*Attorney, Agent, or Firm*—Graybeal, Barnard & Uhlir

[57] ABSTRACT

A slider for use in a slide fastener prevents jamming of a foreign matter within the slider between fastener elements and inner element-guide portions of the slider. The slider has a diverging end and a contracted end, and the diverging end has two openings which are partitioned by an interconnecting web. The two openings lead to two channels which are joined together in the half portion of the slider on the side close to the aforesaid contracted end. The separated fastener elements secured to fastener tapes, respectively, and introduced through the aforesaid channels into the slider are brought into engagement with each other in the aforesaid half portion of the slider. In such a case, a foreign matter, such as a piece of cloth, often jams between the fastener elements and the inner element-guiding portions of the slider. To prevent this, the slider according to the invention provides lip portions which are turned in from the open edges of the aforesaid channels, thereby reducing clearances between the fastener elements and the element-guiding portions of the slider. These lip portions are made of a wear-resistant resilient material.

9 Claims, 8 Drawing Figures

SLIDER FOR USE IN SLIDE FASTENER

BACKGROUND OF THE INVENTION

1. Field of the Invention

This invention relates to a slider for use in a slide fastener, and more particularly to a slider for use in a slide fastener which prevents jamming of a foreign matter between fastener elements and element-guiding portions of the slider.

2. Description of the Prior Art

In a slide fastener, fastener elements secured to fastener tapes or stringers on the opposite sides are engaged or separated due to a slider moving in one direction or the other. The slide fastener is convenient for use with clothing, bags, and many other things to be closed and hence finds a wide application.

However, a slide fastener, particularly, a slider thereof suffers from jamming of a foreign matter between fastener elements and inner element-guiding portions of the slider, particularly when the elements are to be engaged with each other. This leads to a damage to the slider itself, even to a material nipped therebetween.

One of typical sliders in the prior art slide fasteners will be described with reference to FIGS. 1 and 2, hereunder, FIG. 1 is a plan view of a slider for use in a slide fastener, and FIG. 2 is a front view of the slider as viewed from the diverging end of the slider.

Shown at $\mathbf{1}_1$ and $\mathbf{1}_2$ are left-hand and right-hand fastener elements, which are secured to fastener tapes or stringers. Shown at 2 is a slider. The slider 2 has a contracted end and a diverging end. The diverging end of the slider 2 is provided with two openings which are partitioned by an interconnecting web 6. The two openings lead to two channels *2a,2a* in the slider, as shown. The slider 2 consists of an upper flat portion 7, a lower flat portion 8 and an interconnecting web 6 which interconnects the upper and lower flat portions 7 and 8 together. The side edges of the upper and lower flat portions 7, 8 are formed with inturned flanges 10, 10 which guide the fastener elements passing through the slider 2. A hook 3 is attached to the slider 2 for pulling the latter, when fastener elements are to be engaged or separated. In this respect, for achieving smooth introduction of the fastener elements into the slider, there should be provided clearances $X_1$, $X_2$ between the inturned flanges 10 and the tails of fastener elements positioned within the slider, as well as clearances $Y_1$ and $Y_2$ between the inner surfaces of the flat portions 7,8 and the fastener elements $\mathbf{1}_1$, $\mathbf{1}_2$. In general, the clearances $Y_1$, $Y_2$ correspond to 10 to 20% of the height of a fastener element, while the clearances $X_1$, $X_2$ correspond to 25 to 40% of the length of a fastener element. The clearances $X_1$, $X_2$ are referred to as transverse-direction clearances, while the clearances $Y_1$, $Y_2$ are referred to as vertical-direction clearances. In this respect, if the aforesaid range of clearances are reduced, then there results lack of smooth sliding in fastener elements through the slider. On the other hand, the provision of the aforesaid clearances leads to jamming of a foreign matter between fastener elements and element-guiding portions of the slider, such as inturned flanges 10,10 or flat portions 7,8 of the slider.

SUMMARY OF THE INVENTION

It is an object of the present invention to provide a slider for use in a slide fastener, which prevents jamming of a foreign matter within the slider.

According to the present invention, there is provided a slider for use in a slide fastener, which includes a diverging end having two channels partitioned by a interconnecting web and defined between the upper and lower flat portions of the slider, the aforesaid channels having their open edges formed with lip portions which are turned in but sligtly outwardly of the slider, and which are made of a wear-resisting resilient material.

DESCRIPTION OF THE PREFERRED EMBODIMENTS

Figure 1:
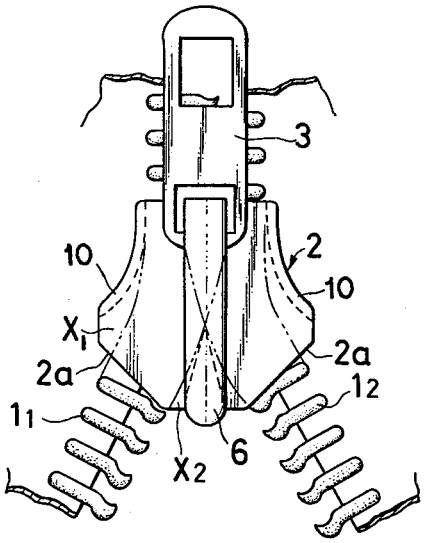
FIG. 1 is a plan view of a prior art slide fastener.
Figure 2:
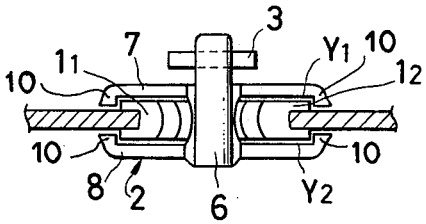
PRIOR ART FIG. 2
FIG. 2 is a front view of the prior art slide fastener of FIG. 1.

The fundamental arrangement of the slider for use in a slide fastener according to the present invention is identical to that of the prior art slide fastener shown in FIGS. 1 and 2.

Figure 3:
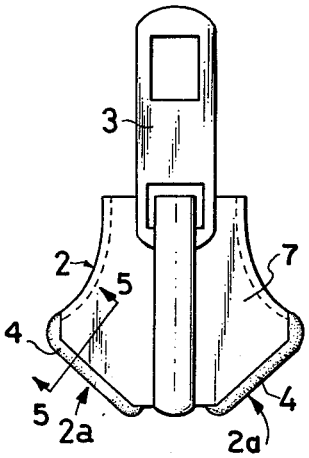
PRIOR ART FIG. 3
FIG. 3 is a plan view of a slide fastener according to the present invention.
Figure 4:
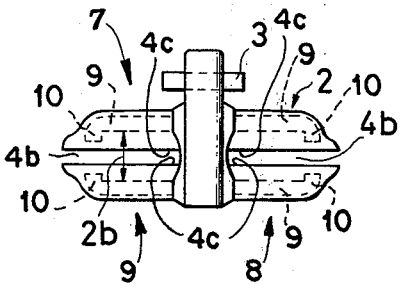
FIG. 4 is a front view of the slide fastener according to the present invention, which is shown in FIG. 3.
Figure 5:
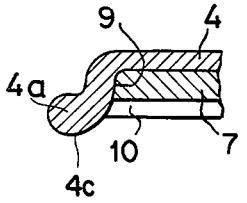
FIG. 5 is a cross sectional view of a lip portion coated over the outer surface of a slider according to the present invention, which portion is made of a wear-resisting resilient material.

As shown in FIGS. 3–5, the open edges 9 of channels *2a, 2a* in the slider 2 are coated with a wear-resisting resilient material so as to form lip portions 4 which are turned in from the open edges 9 of the channels *2a,2a,* but slightly outwardly thereof. The lip portions 4 define element introducing openings *4b* at the entrances of channels *2a,2a.* The vertical width of the element-introducing openings *4b* is considerably smaller than a vertical spacing *2b* between the upper and lower flat portions 7,8 of the slider.

FIG. 5 shows the cross-sectional view of the lip portion 4 of the slider most typical according to the present invention taken along line 5—5 of FIG. 3. As shown, the lip portion 4 has its edge *4a* which projects slightly outwardly, and provides a smooth element-contacting surface *4c.*

Figure 6A:
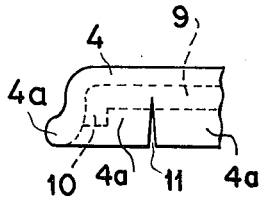
FIGS. 6A, 6B, and 6C are views showing various modifications of the lip portion of FIG. 5.
Figure 6B:
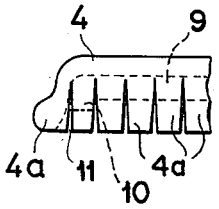
Figure 6C:
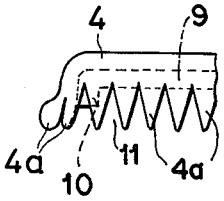

FIGS. 6A–6C show various modifications of the lip portion 4 having cuts 11 as shown. The form of the cuts may be of a wedge type or any other shape, and the number of the cuts may be single or plural, as required.

FIG. 6A shows a lip portion having a single cut, FIG. 6B shows a lip portion having a plurality of cuts, and FIG. 6C shows a lip portion of a comb shape.

The lip portion 4 however should be made of a wear resisting resilient material such as polyamide resin, teflon, and the like. This is because of the frequent use of the slider for engagement and separation of the fastener elements.

The lip portions may be provided by dipping a slider in a molten resin.

Although the present invention has been described with reference to specific details of certain embodiments thereof, it is not intended that such details be limitations upon the scope of the invention except in insofar as set forth in the following claims.

What is claimed is:

1. A slider, for use in a slide fastener having fastening elements, comprising:

upper and lower flat portions having inturned side flanges;

an interconnecting web which interconnects said upper and lower flat portions; and a pair of both upper and lower lip portions; wherein said interconnecting web, said upper and lower flat portions and said inturned flanges define two channels at the diverging end of said slider, and said two channels have a pair of both upper and lower open edges at said diverging end which are coated with their respective said lip portions, said lip portions having turned in portions which are turned in from their respective said flat portions at positions slightly outwardly of said open edges and are adapted to introduce into the slide fastener said fastening elements.

2. A slider as set forth in claim 1, wherein said lip portions are made of a wear-resisting resilient material.

3. A slider as set forth in claim 1, wherein said lip portions have at least one cut to improve their resiliency.

4. In a slider for use in a slide fastener, wherein the slider is of the type which includes:

upper and lower flat portions having inturned side flanges;

an interconnecting web which interconnects said upper and lower flat portions; and a pair of both upper and lower lip portions; wherein said interconnecting web, said upper and lower flat portions and said inturned flanges define two channels at the diverging end of said slider, and said two channels have a pair of both upper and lower open edges at said diverging end which are coated with their respective said lip portions, said lip portions being turned in from their respective said flat portions at positions slightly outwardly of said open edges;

the method of coating said open edges with lip portions, comprising the step of dipping said open edges in molten resin.

5. A slider as set forth in claim 1, wherein said turned in portions of said pairs of upper and lower lip portions are at least about as long as the fastening elements they are adapted to receive, and define a pair of fastener element receiving slots.

6. A slider as set forth in claim 1, wherein in a free condition said respective lip portions define a pair of fastener element receiving slots, having a height less than about the height of the fastener elements which the slots are adapted to receive, and comprise a resilient, wear-resistant material, so that during use said fastener elements are sandwiched under some pressure between said respective lip portions which act as scrapers to push away any foreign material which might otherwise enter and jam the slider.

7. A slider as set forth in claim 6, wherein said lip portions have at least one cut to improve their resiliency.

8. A slider as set forth in claim 1, wherein said respective lip portions comprise a wear-resistant, resilient material and snugly, slidingly contact the upper and lower surfaces of the fastener elements that they are adapted to receive during use, whereby said lip portions act as a scraper to push away any foreign material which might otherwise enter and jam the slider by holding the fastener elements tightly therebetween.

9. A slider as set forth in claim 8, wherein said lip portions have at least one cut to improve their resiliency.

* * * * *